US008541715B2

(12) United States Patent
Overend et al.

(10) Patent No.: US 8,541,715 B2
(45) Date of Patent: Sep. 24, 2013

(54) HAIR IRON AND METHODS OF OPERATION THEREOF

(76) Inventors: Paul Overend, Silsden (GB); Colin Dawson, Silsden (GB); Andrew Shenton, Silsden (GB)

( * ) Notice: Subject to any disclaimer, the term of this patent is extended or adjusted under 35 U.S.C. 154(b) by 1128 days.

(21) Appl. No.: 12/158,224

(22) PCT Filed: Nov. 14, 2006

(86) PCT No.: PCT/GB2006/004235

§ 371 (c)(1),
(2), (4) Date: Oct. 27, 2008

(87) PCT Pub. No.: WO2007/057649

PCT Pub. Date: May 24, 2007

(65) Prior Publication Data

US 2009/0044823 A1 Feb. 19, 2009

(30) Foreign Application Priority Data

Nov. 18, 2005 (GB) ..... 0523449.7

(51) Int. Cl.
*H05B 1/02* (2006.01)
*A45D 1/28* (2006.01)

(52) U.S. Cl.
USPC ..... 219/225; 219/492; 219/494; 132/229; 132/269

(58) Field of Classification Search
None
See application file for complete search history.

(56) References Cited

U.S. PATENT DOCUMENTS

| | | | | |
|---|---|---|---|---|
| 4,100,397 | A | 7/1978 | Kunimi | |
| 4,354,092 | A | 10/1982 | Manabe et al. | |
| 4,565,916 | A | 1/1986 | Tsuji et al. | |
| 4,673,798 | A * | 6/1987 | Contri et al. | 219/225 |
| 4,739,151 | A | 4/1988 | Smal | |
| 4,803,342 | A * | 2/1989 | Steers et al. | 219/257 |
| 4,999,480 | A * | 3/1991 | Smith | 219/242 |
| 5,160,831 | A * | 11/1992 | Thaler et al. | 219/506 |
| 5,223,694 | A | 6/1993 | Tsuji et al. | |
| 5,311,268 | A * | 5/1994 | Ohzeki et al. | 399/42 |
| 5,345,055 | A | 9/1994 | Leung | |
| 5,354,967 | A | 10/1994 | Barzilai et al. | |
| 5,595,672 | A * | 1/1997 | Sham et al. | 219/257 |
| 5,719,379 | A * | 2/1998 | Huang et al. | 219/502 |
| 5,785,064 | A * | 7/1998 | Simpson | 132/226 |
| 6,070,596 | A | 6/2000 | Altamore | |
| 6,079,133 | A * | 6/2000 | Netten | 38/77.7 |
| 6,307,181 | B1 * | 10/2001 | Hashimoto | 219/223 |
| 6,307,182 | B1 * | 10/2001 | Lile | 219/257 |
| 6,512,210 | B2 * | 1/2003 | Tanaka et al. | 219/541 |
| 6,720,537 | B2 * | 4/2004 | Prager | 219/506 |
| 6,865,825 | B2 * | 3/2005 | Bailey et al. | 36/88 |
| 7,015,429 | B2 * | 3/2006 | Lau et al. | 219/441 |

(Continued)

FOREIGN PATENT DOCUMENTS

| | | |
|---|---|---|
| DE | 19907721 | 3/2000 |
| EP | 0352879 | 1/1990 |

(Continued)

*Primary Examiner* — Joseph M Pelham

(57) ABSTRACT

There are provided hair irons. In a preferred embodiment an electric hair iron (1) comprises at least one heating element and control means comprising a temperature sensor and a control circuit. The control means is arranged such that power is only supplied to the heating element or elements when the temperature sensed by the sensor is at or above a predetermined minimum temperature. Also provided are methods of straightening hair.

29 Claims, 2 Drawing Sheets

(56) References Cited

U.S. PATENT DOCUMENTS

| | | | | |
|---|---|---|---|---|
| 7,783,177 | B2 | 8/2010 | Ikesaki | |
| 2003/0089700 | A1 | 5/2003 | Chang et al. | |
| 2004/0040948 | A1 * | 3/2004 | Mandell et al. | 219/222 |
| 2005/0098192 | A1 | 5/2005 | Cafaro | |
| 2005/0269309 | A1 * | 12/2005 | Lau et al. | 219/441 |
| 2006/0086712 | A1 * | 4/2006 | Feldmeier | 219/250 |

FOREIGN PATENT DOCUMENTS

| | | | |
|---|---|---|---|
| EP | 1112701 | | 7/2001 |
| EP | 1417905 | | 5/2004 |
| ES | 2112149 | | 3/1998 |
| GB | 2142817 | | 1/1985 |
| GB | 2405584 | | 9/2005 |
| JP | 20010137038 | A | 5/2001 |
| JP | 2004147408 | | 5/2004 |
| KR | 20030005920 | | 1/2003 |
| KR | 20030052925 | | 6/2003 |
| WO | 03056971 | | 7/2003 |

* cited by examiner

HAIR IRON AND METHODS OF OPERATION THEREOF

FIELD OF INVENTION

The present invention relates to hair irons.

BACKGROUND TO THE INVENTION

It is known for persons to employ hair irons to straighten their hair. There are known electric irons employing ceramic heating elements which comprise a layer of resistant material laid upon or sandwiched between ceramic material. These irons may reach operating temperature within fractions of a minute and may therefore be convenient to use. However, known irons may not operate as efficiently as they might and may be prone to moisture damage.

Accordingly, preferred embodiments of the present invention aim to address at least one disadvantage associated with known hair irons whether discussed herein or otherwise.

SUMMARY OF THE INVENTION

According to a first aspect of the present invention there is provided an electric hair iron comprising at least one heating element and control means comprising a temperature sensor and a control circuit and wherein the control means is arranged such that power is only supplied to the heating element or elements when the temperature sensed by the sensor is at or above a predetermined minimum temperature.

Suitably, the iron comprises first and second jaws at least one of which carries a heating element, the jaws being moveable such that, in use, the jaws can be moved to an open configuration and hair introduced between them and then the jaws can be moved to a closed configuration with hair lying there between.

Suitably, the first jaw carries a first heating element and the second jaw carries a second heating element. Suitably, the heating elements are arranged such that hair can lie between them when the jaws are in the closed configuration.

Suitably, the predetermined minimum temperature is between 0° C. and 10° C.: Preferably, the predetermined minimum temperature is between 2° C. and 8° C. Suitably, the predetermined minimum temperature is at least 2° C., preferably at least 5° C. Suitably, the predetermined minimum temperature is no greater than 8° C., preferably no greater than 5° C. The predetermined minimum temperature may for example be 2° C., 3° C., 4° C., 5° C., 6° C., 7° C. or 8° C.

In use, if the iron is too cold it may contain condensation. Suitably, the control means is thus arranged to prevent the supply of power to the heating element or elements if the iron is below the predetermined minimum temperature and may contain condensation. The control means may thus prevent operation of the iron in conditions in which the iron may contain moisture and this may protect the iron from damage and/or ensure a users safety.

Suitably, the iron comprises a power supply switch. Suitably, the control means is arranged to operate when the iron is turned on, suitably using a power supply switch.

Suitably, the control means is arranged to prevent the supply of power to the heating element or elements if the temperature sensor fails. The control means may thus prevent operation of the iron in circumstances under which it is unable to determine whether the iron is too cold and may contain condensation and this may protect the iron from damage and/or ensure a users safety.

The iron may comprise signalling means which may comprise visual signalling means such as a lamp or LED and audio signalling means such as a buzzer or speaker. Suitably, the iron is arranged to provide an indication that the sensed temperature is below the predetermined minimum temperature if a user attempts to operate the iron when it is too cold. The indication may comprise a visual and/or audible signal. Preferably the signal comprises an audible signal, for example an audible warble.

In use, should the iron be too cold a user may thus be given a signal to indicate that the iron should be left for a period of time, which may for example be half an hour, preferably in a warm dry place before attempting use. A user may suitably turn the iron off after being given such a signal. Alternatively, a user may leave the iron on and the iron may enter a standby mode.

Suitably, the iron is arranged such that if it is left on after the control means has determined that the sensed temperature is below the predetermined minimum temperature the iron is placed in a standby mode in which the heating element or elements will not be supplied with power. Suitably, when the iron is in the standby mode the control means continues to compare the sensed and predetermined minimum temperatures and provides a user with a signal once the sensed temperature is at or above the predetermined minimum temperature. The user may then bring the iron out of the standby mode.

Thus, if it is determined that the iron is too cold and the iron is left on the control means may continue to prevent power from being supplied to the heating element or elements if the iron subsequently warms up unless the user takes action, for example by turning the iron off and on again, suitably using a power supply switch. This may prevent the heating elements from being supplied with power without the full knowledge of a user.

Suitably, the iron is arranged to be mains powered. Suitably, the iron is arranged to be powered by an AC power supply. Alternatively, the iron may be arranged to be battery powered.

Suitably, the iron comprises a controlling circuit arranged to control the supply of power to the heating elements during use. Said controlling circuit may comprise the control circuit of the control means.

Suitably, the controlling circuit is arranged to supply power in a pulsed width modulated manner to control the temperature.

Suitably, the hair iron comprises a microcontroller to maintain the temperature of the heating elements within a required operating range.

Suitably, the hair iron is arranged to provide visual and/or audio signals relating to its temperature status and/or operating condition during use.

Suitably a part of each jaw removed from the heating element carried by the jaw comprises a handle portion. Suitably, the iron is arranged to be held in one hand by a user.

Suitably, the jaws are movably connected to one another. Suitably, the jaws are pivotally connected to one another. Suitably, the jaws are connected to one another by ends of the jaws removed from their respective heating elements.

Suitably, the jaws are biased towards their open configuration. The jaws may be spring biased to their open configuration.

The heating element or elements may comprise ceramic heating elements. Each ceramic heating element may comprise a layer of resistant material laid upon or sandwiched between ceramic material.

The heating element or elements may comprise thick film heating elements. Each thick film heating element may comprise a ceramic substrate having a film of resistive material laid thereon to form a resistive element. Such a heating element may comprise a ceramic substrate on one side only of the resistive element. Alternatively, each thick film heating element may comprise a film of resistive material laid on a base to form a resistive element and which is sandwiched by a ceramic substrate.

The hair iron may comprise a cover plate for each heating element which may be arranged to provide a contact surface for engaging a users hair. A cover plate may be arranged to contact the ceramic substrate on the opposite side to that on which the resistive element is provided. Suitably, the cover plate comprises a metal cover plate. The cover plate may comprise aluminium which may be extruded.

Alternatively, the ceramic substrate of each heating element may be arranged to provide a contact surface for engaging a users hair. A surface of the ceramic substrate may be polished to provide said contact surface, which may be substantially smooth. A resistive element may be printed on one side of the substrate and the side of the substrate opposed to the resistive element may be polished to provide said contact surface which may be substantially smooth.

Alternatively, the heating elements may comprise a resistive element embedded within a ceramic substrate. The resistive element may comprise an element having a base, suitably a carbon base. The heating elements may comprise a film of resistive material laid on to the base to form a resistive element. The ceramic substrate may comprise Alumina. A side of the ceramic substrate may be polished to provide a contact surface for engaging a users hair such that the heating elements may act as contact plates. The iron may thus not require cover plates for the heating elements.

Suitably, the heating elements are arranged to reach operating temperature in less than 3 minutes, for example in less than 2 minutes. Suitably, the heating elements are arranged to reach operating temperature in between 20 seconds and 60 seconds, for example between 30 seconds and 35 seconds. Suitably, the heating elements are arranged to have a temperature of around 150° C. to 200° C. in use, for example around 170° C. to 180° C.

Suitably, the hair iron comprises an electric hair iron arranged to be powered by an AC power supply and which comprises control means comprising a control circuit arranged, to determine the voltage of a power supply to the iron and to modify the operation of the iron accordingly by controlling the supply of power to the heating element or elements based on the determined supply voltage.

The iron may comprise any feature according to the second aspect of the present invention which follows.

Suitably, the iron comprises an electric hair iron which comprises control means comprising a control circuit arranged to place the iron in a sleep mode, in which the supply of power to the heating element or elements is stopped, after a period of non-use.

The iron may comprise any feature according to the third aspect which follows.

Suitably, the iron comprises an electric iron which comprises control means comprising a control circuit arranged to regulate the temperature of the heating element or elements using a fuzzy logic profile.

The iron may comprise any feature according to the fourth aspect which follows.

According to a second aspect of the present invention there is provided an electric hair iron arranged to be powered by an AC power supply and wherein the iron comprises at least one heating element and control means comprising a control circuit arranged to determine the voltage of a power supply to the iron and to modify the operation of the iron accordingly by controlling the supply of power to the heating element or elements based on the determined supply voltage.

Suitably, the iron comprises first and second jaws at least one of which carries a heating element, the jaws being moveable such that, in use, the jaws can be moved to an open configuration and hair introduced between them and then the jaws can be moved to a closed configuration with hair lying there between.

Suitably, the iron is arranged to be powered by a mains power supply.

Suitably the control means is arranged to monitor the temperature of a heating element over an initial warm up period after the iron is switched on. Suitably, using a power supply switch and to compare the temperature gradient during the initial warm up period to a threshold value and from this determine the supply voltage and then modify the operation of the iron according to the determined supply voltage.

Suitably, the iron is arranged to operate at first and second voltage levels. Suitably, the first voltage level is higher than the second voltage level and is around 1.5 to 2.5 times the second voltage level. Suitably, the first voltage level is between 210V and 260V, for example 220V and 250V, for example 240V. Suitably, the second voltage level is between 90V and 130V, for example between 100V and 120V, for example 110V.

Suitably, the iron is arranged such that if the control means determines the supply voltage to be at a first voltage level the iron is controlled to operate the heating element or elements using the half-phase AC supply.

Suitably, the iron is arranged such that if the control means determines the supply voltage to be at a second voltage level the iron is controlled to operate the heating element or elements using the full phase AC supply.

Suitably, having determined the supply voltage the control means saves that value for subsequent use.

If the iron is turned on while the heating element or elements are still warm, for example above 100° C., the temperature-gradient technique may not be reliable. Suitably, the iron is arranged such that if the iron is turned on while the heating element or elements are still warm, for example above 100° C., the control means may use the saved value of the determined supply voltage to determine how to control the supply of power to the heating element or elements.

Suitably, during the initial warm up time period the heating element or elements are supplied with power using the half-phase AC supply.

The iron may comprise an iron according to the first aspect described hereinbefore or according to the third and fourth aspect described hereafter.

The iron may comprise any feature as described in relation to the first and/or third and/or fourth aspect except where such features are mutually exclusive.

According to a third aspect of the present invention there is provided an electric hair iron comprising at least one heating element and control means comprising a control circuit arranged to place the iron in a sleep mode, in which the supply of power to the heating element or elements is stopped, after a period of non-use.

Suitably, the iron comprises first and second jaws at least one of which carries a heating element, the jaws being moveable such that, in use, the jaws can be moved to an open configuration and hair introduced between them and then the jaws can be moved to a closed configuration with hair lying there between.

Suitably, the iron is arranged such that after being placed in a sleep mode a user must take positive action to reactivate it.

The iron may be arranged such that it can only be reactivated after being placed in the sleep mode by being turned off and on again, suitably using a power supply switch.

Suitably, the control means comprises a timer which is arranged to re-set each time the temperature of the heating element or elements falls below a threshold temperature. Suitably, said timer comprises a count-down timer.

Suitably, the timer counts a period of between 3 and 18 minutes, for example between 5 and 15 minutes for example around 10 minutes.

Suitably, the threshold temperature is between 150 and 200° C., preferably between 170 and 180° C., for example 175° C. The threshold temperature may comprise a target temperature which the control means aims to heat the element or elements to.

Suitably, the iron is arranged such that, in use, heat exchange between the heating element or elements and a users hair causes the element or elements to periodically drop below a threshold temperature. The timer may thus be set to count an interval of time greater than the time period which separates successive times at which the element or elements fall below the threshold temperature during use.

If the iron is in use the temperature will keep dropping below the threshold temperature before the timer reaches the end of its count and the timer will keep resetting. If the iron is not used, for all or a substantial part of an interval of time counted by the timer the heating element or elements suitably do not fall below the threshold temperature. The timer may thus reach the end of its count without resetting. Suitably, the iron is arranged such that when the timer reaches the end of its count the iron is placed in the sleep mode.

Suitably, provided the iron is used for at least 25% of a counted time period, preferably for at least 50% of a counted time period, for example at least 75%, the temperature of the heating element or elements will fall below the threshold temperature such that the timer is reset and the iron will remain active and not enter the sleep mode.

Suitably, contacting the iron with hair for at least 30 seconds will cause the temperature of the heating element or elements to drop below the threshold such that the timer resets.

The iron may comprise an iron according to the first or second aspect described hereinbefore or the fourth aspect described hereafter.

The iron may comprise any feature as described in relation to the first and/or second and/or fourth aspect except where such features are mutually exclusive.

According to a fourth aspect of the present invention there is provided a hair iron comprising at least one heating element and control means comprising a control circuit arranged to regulate the temperature of the heating element or elements using a fuzzy logic profile.

Suitably, the iron comprises first and second jaws at least one of which carries a heating element, the jaws being moveable such that, in use, the jaws can be moved to an open configuration and hair introduced between them and then the jaws can be moved to a closed configuration with hair lying there between.

Suitably, the control means is arranged to control power is supply to the heating element or elements to control the element or elements to be around a target temperature.

Suitably, the control means is such that the regulation becomes stronger the greater the deviation of the temperature from the heater element or elements from the target temperature.

Suitably, the control means is arranged to place the iron in a sleep mode if the temperature of the heating element or elements does not drop below a threshold temperature during a predetermined time period.

Suitably, the target temperature is between 150 and 200° C., preferably between 170 and 180° C., for example 175° C. Suitably, the target temperature corresponds to a threshold temperature.

Suitably, to assist non-use detection the regulation may provide weak control around the threshold temperature.

The iron may comprise an iron according to the first, second or third aspect described hereinbefore.

The iron may comprise any feature as described in relation to the first and/or second and/or third aspect except where such features are mutually exclusive.

According to a fifth aspect of the present invention there is provided a method of straightening hair, wherein the method employs an iron according to the first and/or second and/or third and/or fourth aspect and wherein the method comprises a user turning on the iron following which a control; means of the iron determines how electrical power is provided to the heating element or elements of the iron.

The iron may comprise an iron according to the first aspect and the method may comprise:

(i) a user turning on the iron;

(ii) a temperature sensor of the control means sensing the iron temperature and a control circuit of the control means determining whether the temperature is (a) at or above a predetermined minimum temperature, in which case power is supplied to the heating element or elements or (b) below a predetermined minimum, in which case this is signaled to a user and the supply of electrical power to the heating element or elements is prevented;

(iii) a user leaving the iron for a period of time if condition (b) applies and optionally relocating the iron to a warm dry place, following which steps (i) and (ii) are repeated; and (iv) a user contacting the warmed iron with hair once condition (a) applies and the heating element or elements are heated by electrical power supplied thereto.

The iron may comprise an iron according to the second aspect and the method may comprise:

(i) a user turning on a supply of AC electrical power to the iron;

(ii) the control circuit of the control means determining the voltage of the power supply and modifying the operation of the iron accordingly by controlling the supply of power to the heating element or elements based on the determined supply voltage; and (iii) a user contacting the warmed iron with hair once the heating element or elements are heated by electrical power supplied thereto.

The iron may comprise an iron according to the third aspect and the method may comprise:

(i) a user turning on the iron;

(ii) a user contacting the warmed iron with hair once the heating element or elements are heated by electrical power supplied thereto; and (iii) the control circuit of the control means determining when the iron has not been used for a predetermined period of time and stopping the supply of power to the heating element or elements to place the iron in a sleep mode.

The iron may comprise an iron according to the fourth aspect and the method may comprise:

(i) a user turning on the iron;

(ii) a control circuit of the control means using a fuzzy logic profile to regulate the temperature of the heating element or elements; and (iii) a user contacting the warmed iron with hair once the heating element or elements are heated by electrical power supplied thereto.

The method may comprise any feature as described in relation to the first and/or second and/or third and/or fourth aspect except where such features are mutually exclusive.

BRIEF DESCRIPTION OF THE DRAWINGS

The present invention will now be illustrated by way of example with reference to the accompanying drawings in which.

DETAILED DESCRIPTION OF THE PREFERRED EMBODIMENTS

Figure 1:
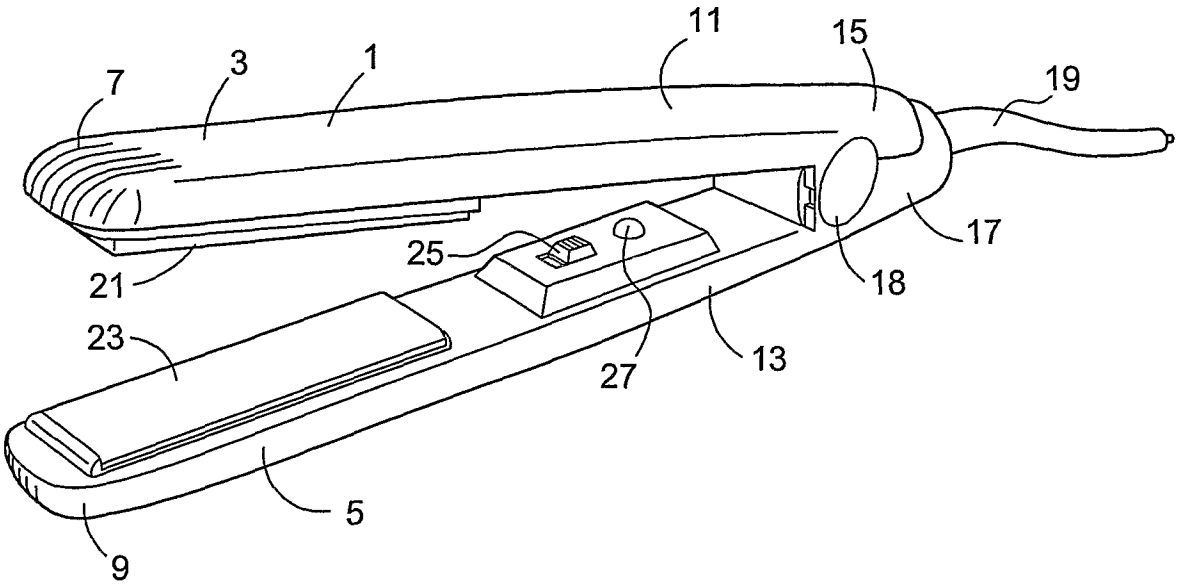
FIG. 1 is a perspective view of a hair iron.

As best illustrated by FIG. 1 a hair iron 1 comprises first and second jaws 3, 5 carrying first and second heating elements (not shown) respectively, at end portions 7,9 of the jaws 3,5. The heating elements comprise ceramic heating elements (not shown) covered by extruded aluminium cover plates 21,23.

The jaws 3, 5 further comprise first and second handle portions 11, 13 respectively towards ends 15, 17 removed from the heating elements.

The jaws 3, 5 are pivotally connected adjacent their ends 15, 17 removed from the heating element by pivot 18. The jaws 3, 5 may thus be moved between open and closed configurations. A spring (not shown) biases the jaws 3, 5 to an open configuration.

The hair iron 1 further comprises a power supply cable 19 for connecting to an AC mains power supply and a power supply switch 25. The switch is moveable between on and off positions. The iron also comprises signalling means comprising an LED 27 and speaker (not shown) to provide visual and audible signals of the operating status of the iron.

The hair iron 1 further comprises a control means comprising a control circuit (not shown) for controlling the supply of power to the heating elements. The control means also includes a timer (not shown) which forms part of the control circuit and a temperature sensor (not shown) for sensing the temperature of the iron. The sensor is located by the heating plate so that the temperature thereof can also be sensed in use.

The control means is arranged to prevent power being supplied to the heating plates unless the sensed temperature of the iron 1 is at or above a predetermined temperature which in a preferred embodiment is set at 5° C. This may ensure the iron 1 can not be operated if it is at a temperature at which it may contain condensation.

The control means is also arranged to determine the voltage of the power supply to which the iron 1 is connected and to modify the irons operation by controlling the supply of power to the heating elements accordingly.

The control means is also arranged to regulate the temperature of the heating plates according to a fuzzy logic profile.

The control means is also arranged to stop the supply of power to the heating elements and place the iron in a sleep mode after a period of non-use.

Figure 2:
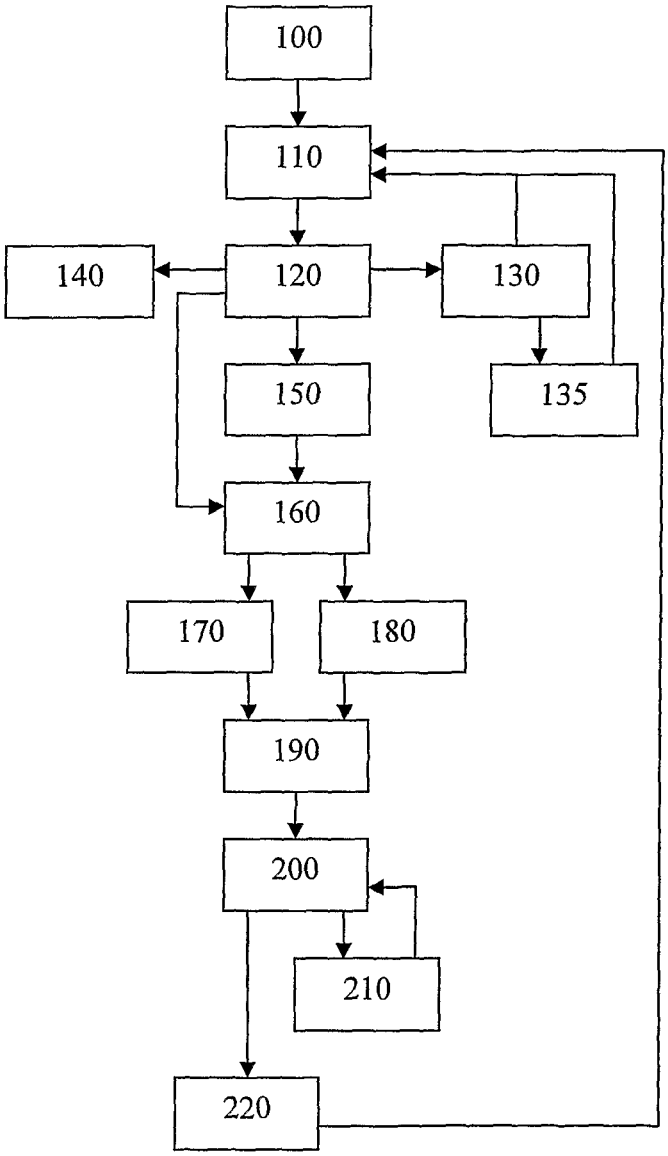
FIG. 2 is a flow diagram illustrating the operation of the iron of FIG. 1.

The operation of the iron is illustrated by FIG. 2.

A user first connects the power supply cable 19 to a power supply (step 100). Following this the user moves the power supply switch 25 of the iron 1 to an on position (step 110).

The control means of the iron 1 then begins to operate. A temperature sensor (not shown) located by a heating plate senses the temperature of the iron. A control circuit (not shown) is programmed with a predetermined minimum temperature which the iron should be at before power is supplied to the heating elements. In the illustrated embodiment this temperature is 5° C. The control circuit thus compares the sensed temperature to the predetermined minimum temperature (step 120).

If the sensed temperature is below the predetermined minimum the iron 1 may contain condensation which could cause damage to the iron 1 if operated. Accordingly, under such conditions the control circuit does not allow the supply of power to the heating elements. Instead it causes the signal means to provide a user with a visual and audible indication that the iron is too cold (step 130).

A user should then switch the iron off and wait for it to warm naturally before use. The user may for example move the iron to a warmer and/or drier location and wait. The control means will continue to prevent power being supplied to the heating elements until steps 110 and 120 are repeated and an appropriate temperature sensed.

If a user does not turn the iron off the iron is arranged to enter a standby mode in which it continues to monitor the temperature (step 135) so that it can inform a user when the iron can be used. However, it will not allow power to be supplied to the heating elements until the iron is turned off and on again, i.e. until steps 110 and 120 are repeated.

If the control circuit is not provided with a sensed temperature it will not allow the supply of power to the heating elements and will provide a user with an indication that the iron 1 has a fault requiring repair (step 140).

If the sensed temperature is determined to be at or above the predetermined minimum the control circuit allows half phase AC power to be supplied to the heating elements in an initial warming stage (step (150). During this stage the control circuit records the temperature gradient. Following the initial warming stage the control circuit compares the temperature gradient to a threshold temperature gradient and determines the supply voltage based on this (step 160). The determined supply voltage is then recorded.

If the iron 1 has been used and then turned off it may be too warm for the temperature gradient approach to work. Accordingly if the sensed temperature exceeds 100° C. the control circuit bypasses step 150 and uses the last recorded value for the determined supply voltage at step 160.

Based on the determined supply voltage the control circuit then controls the supply of power to the heating elements. If the voltage is around 240V the supply of power to the heating elements is set to use the half phase power supply (step 170). If the voltage is around 110V then the supply of power to the heating elements is set to use the full phase power supply (step 180).

Whatever the supply voltage to which the iron 1 is set the control means is arranged to monitor the sensed temperature. Once a target temperature is reached temperature regulation is commenced and a count-down timer is started (step 190).

In the preferred embodiment the target temperature is 175° C. and the timer is set to count a 10 minute interval. The target temperature also serves as a threshold temperature which is used to reset the count-down timer.

The temperature regulation is provided by the control circuit using a fuzzy logic profile (step 200) which aims to maintain the temperature of the heating elements at the target temperature, around 175° C. The fuzzy logic control is though set to allow the temperature of the heating elements to be dropped below the target temperature due to heat exchange with hair at least once in the time interval counted by the count-down timer.

When the temperature sensor provides the control means with a signal that the temperature has dropped below the target temperature the count-down timer is reset (step 210) and the fuzzy logic control (step 200) continued.

If the iron is not used for a period of time then the temperature of the heating elements will not drop below the threshold value before the count-down timer reaches zero. Thus, if the count-down timer reaches zero the control means determines that the iron is not in use and stops the supply of power to the heating elements, placing the iron is sleep mode (step 220). If a user wishes to continue to use the iron they must turn the iron off and on, thus returning to step 110.

In an alternative embodiment, not illustrated, the control means is arranged only to provide fuzzy logic temperature control without the other discussed control functions. In another embodiment, not illustrated, the control means is arranged only to provide the power supply control function without the other discussed control functions. In another alternative embodiment, not illustrated, the control means is arranged only to provide the start up temperature check control function without the other discussed control functions. In a further alternative embodiment, not illustrated, the control means is arranged only to provide the non-use sleep mode control function without the other discussed control functions. In other embodiments, not illustrated, the iron comprises a combination of two or more of these control features.

It will be appreciated that a hair iron according to preferred embodiments of the present invention may advantageously allow a user to straighten their hair and may be efficient and safe to operate.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An electric hair iron comprising at least one heating element and control means comprising a temperature sensor and a control circuit and wherein the control means is arranged such that power is only supplied to the at least one heating element when the temperature sensed by the sensor is at or above a predetermined minimum temperature.

2. The iron according to claim 1, wherein the predetermined minimum temperature is between 0° C. and 10° C.

3. The iron according to claim 1, wherein the control means is arranged to prevent the supply of power to the heating element or elements if the temperature sensor fails.

4. The iron according to claim 1, wherein the hair iron is arranged to provide visual and/or audio signals relating to its temperature status and/or operating condition during use.

5. The iron according to claim 1, wherein the iron is arranged such that if it is left on after the control means has determined that the sensed temperature is below the predetermined minimum temperature the iron is placed in a standby mode in which the at least one heating element will not be supplied with power.

6. The iron according to claim 5, wherein when the iron is in the standby mode the control means continues to compare the sensed and predetermined minimum temperatures and provides a user with a signal once the sensed temperature is at or above the predetermined minimum temperature.

7. The iron according to claim 1, wherein the hair iron comprises a microcontroller to maintain the temperature of the at least one heating element within a required operating range.

8. The iron according to claim 1, wherein the iron is arranged to be powered by an AC power supply and wherein the control means comprises a control circuit arranged to determine the voltage of a power supply to the iron and to modify the operation of the iron accordingly by controlling the supply of power to the at least one heating element based on the determined supply voltage.

9. The iron according to claim 1, wherein the control means comprises a control circuit arranged to place the iron in a sleep mode, in which the supply of power to the at least one heating element is stopped, after a period of non-use.

10. The iron according to claim 1, wherein the control means comprises a control circuit arranged to regulate the temperature of the at least one heating element using a fuzzy logic profile.

11. The iron according to claim 10, wherein the control means is arranged to control power supply to the at least one heating element to control the element or elements to be around a target temperature.

12. The iron according to claim 11, wherein the target temperature is between 150 and 200° C.

13. The iron according to claim 11, wherein the target temperature corresponds to a threshold temperature.

14. The iron according to claim 10, wherein the control means is arranged to place the iron in a sleep mode if the temperature of the at least one heating element does not drop below a threshold temperature during a predetermined time period.

15. The iron according to claim 8, wherein the control means is arranged to monitor the temperature of a heating element over an initial warm up period after the iron is switched on.

16. The iron according to claim 8, wherein a temperature gradient during the initial warm up period is compared to a threshold value and from this a supply voltage is determined and the operation of the iron is modified according to the determined supply voltage.

17. The iron according to claim 8, wherein the iron is arranged to operate at first and second voltage levels.

18. The iron according to claim 8, wherein having determined the supply voltage the control means saves that value for subsequent use.

19. A method of straightening hair, wherein the method employs an iron according to claim 1, and wherein the method comprises a user turning on the iron following which a control means of the iron controls the supply of electrical power to the at least one heating element of the iron.

20. A method of straightening hair using the iron according to claim 1, comprising:

(i) a user turning on the iron;

(ii) a temperature sensor of the control means sensing the iron temperature and a control circuit of the control means determining whether the temperature is (a) at or above a predetermined minimum temperature, in which case power is supplied to the at least one heating element or (b) below a predetermined minimum, in which case this is signalled to a user and the supply of electrical power to the at least one heating element is prevented;

(iii) a user leaving the iron for a period of time if condition (b) applies, (iv) following which steps (i) and (ii) are repeated; and (v) a user contacting the warmed iron with hair once condition (a) applies and the at least one heating element is heated by electrical power supplied thereto.

21. An electric hair iron comprising at least one heating element and control means comprising a control circuit arranged to place the iron in a sleep mode, in which the supply of power to the at least one heating element is stopped, after a period of non-use wherein the control means comprises a timer which counts a time period and which is arranged to reset each time the temperature of the at least one heating element falls below a threshold temperature.

22. The iron according to claim 21, wherein the iron is arranged such that it can only be reactivated after being placed in the sleep mode by being turned off and on.

23. The iron according to claim 21, wherein the timer counts a period of between 3 and 18 minutes.

24. The iron according to claim 21, wherein the threshold temperature is between 150 and 200° C.

25. The iron according to claim 21, wherein the threshold temperature is set such that provided the iron is used for at least 25% of a counted time period, the temperature of the at least one heating element will fall below the threshold temperature such that the timer is reset and the iron will remain active and not enter the sleep mode.

26. The iron according to claim 21, wherein the threshold temperature is set such that contacting the iron with hair for at least 30 seconds will cause the temperature of the at least one heating element to drop below the threshold such that the timer resets.

27. The iron according to claim 21, wherein the iron is arranged such that when the timer reaches the end of its count the iron is placed in the sleep mode.

28. The iron according to claim 21, wherein the threshold temperature comprises a target temperature which the control means aims to heat the at least one heating element.

29. A method of straightening hair using the iron of claim 21, comprising:

(i) a user turning on the iron;

(ii) a user contacting the warmed iron with hair once the at least one heating element is heated by electrical power supplied thereto; and (iii) the control circuit of the control means determining when the iron has not been used for a predetermined period of time and stopping the supply of power to the at least one heating element to place the iron in a sleep mode.

* * * * *